US007322075B2

(12) United States Patent
Ozaki et al.

(10) Patent No.: US 7,322,075 B2
(45) Date of Patent: Jan. 29, 2008

(54) METALLIC SLIDE FASTENER ELEMENT AND METHOD FOR MANUFACTURING THE SAME

(75) Inventors: Teruo Ozaki, Toyama-ken (JP); Makoto Yoshida, Toyama-ken (JP); Futoshi Kozato, Toyama-ken (JP)

(73) Assignee: YKK Corporation, Tokyo (JP)

( * ) Notice: Subject to any disclaimer, the term of this patent is extended or adjusted under 35 U.S.C. 154(b) by 189 days.

(21) Appl. No.: 11/062,355

(22) Filed: Feb. 22, 2005

(65) Prior Publication Data

US 2005/0183246 A1 Aug. 25, 2005

(30) Foreign Application Priority Data

Feb. 25, 2004 (JP) ..... 2004-049520

(51) Int. Cl.
*A44B 19/06* (2006.01)

(52) U.S. Cl. ..... 24/414; 24/403; 24/405

(58) Field of Classification Search ..... 24/403, 24/405, 413, 414
See application file for complete search history.

(56) References Cited

U.S. PATENT DOCUMENTS 2,622,295 A 12/1952 Mikulas
2,685,127 A 8/1954 Kaufmann
4,010,520 A * 3/1977 Yoshida ..... 24/411
4,306,347 A 12/1981 Kasai

FOREIGN PATENT DOCUMENTS

| | | | |
|---|---|---|---|
| GB | 1397862 | | 6/1975 |
| JP | 55-075836 | A | 6/1980 |
| JP | 59-010858 | | 3/1984 |
| JP | 59-010859 | | 3/1984 |
| JP | 1-80012 | | 5/1989 |
| JP | 09017929 | A * | 1/1997 |

* cited by examiner

*Primary Examiner*—James R. Brittain
(74) *Attorney, Agent, or Firm*—Alston & Bird LLP

(57) ABSTRACT

A metallic slide fastener element in which an exposed portion outside of an element is finished uniformly with a high smoothness and the fixing strength to a fastener tape is intensified, and a method for effectively manufacturing the same element, wherein a metallic flat type wire rod is placed on a die and the flat type wire rod is punched out with a punch so as to produce a slide fastener element, and at this time, a mouth on a punch side of the die or a peripheral edge of the die is chamfered at a radius of 0.01 to 1.0 mm and a clearance between the punch and the die is set to 0 to 30 μm, so that an element, which has a cut surface comprising a shear surface of 80% or more and a fracture surface of less than 20% and is suitable as a slide fastener to be attached to a high quality product, is obtained.

3 Claims, 7 Drawing Sheets

METALLIC SLIDE FASTENER ELEMENT AND METHOD FOR MANUFACTURING THE SAME

BACKGROUND OF THE INVENTION

1. Field of the Invention

The present invention relates to a slide fastener element to be manufactured by punching out a metallic flat type wire rod, and a method for manufacturing the element.

2. Description of the Related Art

A metallic element of a slide fastener, the element comprising a coupling head and right and left leg portions extending separately as two branches from the head on a same plane, is generally manufactured according to the following two typical manufacturing methods. According to one of these methods, a long wire rod having a Y-shaped section is rolled out through multiple stages, and then this wire rod is cut out successively in a longitudinal direction of the wire rod in a desired thickness so as to obtain a Y-shaped element material. By deforming a portion of that material corresponding to a coupling head locally under a pressure, the engagement portion is formed and elements are produced. The elements produced in this way are implanted successively at a constant pitch on a side edge of a long fastener tape carried separately so as to manufacture a fastener chain continuously.

According to the other method, a flat type wire rod is punched out into the shape of an element by using a die or a punch successively, and it is deformed plastically under a pressure so as to form a coupling head, thereby producing elements individually. After the elements manufactured in this way are subjected to barrel polishing or chemical polishing, they are implanted successively along a side edge of a fastener tape at a constant pitch so as to produce a continuous fastener chain. In the element manufactured by the latter method, the shape in appearance and structure of the coupling head of the element are particularly wide-ranging, since the die and the punch can be formed into diversified shapes. In the simplest shape of the coupling head, one side of the central portion of the coupling head defined by combination of a trapezoidal shape and a rectangular shape is recessed while the other side is constituted of an engagement portion projecting in a mountainous shape. On the other hand, other typical structures have been disclosed in, for example, Japanese Patent Application Publication No. 59-10858 (patent document 1), Japanese Patent Application Publication No. 59-10859 (patent document 2), Japanese Utility Model Application Laid-Open No. 1-80012 (patent document 3) and the like.

As for the typical shape and structure of an element obtained by punching out a flat type wire rod, which is disclosed in these patent documents 1 to 3, the element comprises a coupling head 2 and right and left leg portions 4 as shown in FIG. 1. The coupling head 2 includes a flat plate portion 8 having a thickness ⅓ of that of the leg portions 4, swollen portions 3, which are engagement portions swollen on front and rear faces substantially in a center of the flat plate portion, and fitting concave portions 6, which are formed in a flat face portion extending on the same plane as the leg portions of the flat plate portion 8, such that each of the fitting concave portions surrounds a side face on a leg portion side of the swollen portion 3 with a predetermined gap. A part of the swollen portion 3 of a mating element is fitted in between the fitting concave portion 6 and the swollen portion 3, so that the elements are engaged with each other. In addition, the element further comprises nipping portions 7 which are provided at front ends of the right and left leg portions 4 and extend so as to approach each other.

Meanwhile, in the metallic element in which the aforementioned metallic wire rod having a Y-shaped section subjected to being rolled out is cut and then, the engagement portion of the coupling head is molded by pressing, no abnormal quality face is formed on a processed surface of the element because an external peripheral faces of the right and left leg portions and the coupling head of the obtained element are rolled out, so that entirely uniform surface is obtained. However, as for the metallic element called an individual element which is disclosed in the patent documents 1 to 3, a sheared portion and a fracture portion are usually generated in a cut surface when the element is cut out and punched out with a punch. In the sheared portion, an extremely flat shear surface is formed and a fracture surface having a high roughness, containing fine unevenness like scratched flaw is formed in a part of the fracture portion. The metallic element called the individual element is often used in a slide fastener to be attached to a high quality product. Thus, in case of this individual element, an outside exposed surface of the element after implanted in a fastener tape needs to be finished at a high precision.

Further, this kind of the individual element is subjected to barrel polishing or chemical polishing for finishing after the element material is produced by punching out the metallic flat type wire rod by using the die and the punch as described above and at this time, the roughness of a fracture surface is often intensified by such polishing action. For the reason, after finished as a product, a difference between the shear surface and the fracture surface become evident. Thus, in a slide fastener in which such elements are implanted in the fastener tape, particularly the surface of an outside exposed portion of the element, that is, the outer side faces of right and left leg portions and the outer peripheral face of the coupling head look like not finished uniformly. This can be a fatal defect for a slide fastener attached to a high quality product.

On the other hand, to fix this kind of the metallic element to the fastener tape, a core thread portion formed on a side edge of the fastener tape is nipped by right and left leg portions and the right and left leg portions are caulked firmly. The fixing strength at this time depends on the amount of biting of the front end nipping portions of the right and left leg portions into the fastener tape and the nipping strength to the core thread portion. As long as this viewpoint is taken, the higher roughness of the inner peripheral face of each of the right and left leg portions is more preferable.

SUMMARY OF THE INVENTION

The present invention has been accomplished to solve the above-described problem, which is likely to occur in a conventional slide fastener element called individual element, and an object of the invention is to provide a metallic element whose finish to be exposed outside is performed uniformly with a high flatness and further, to provide a metallic element having a high fixing strength to a fastener tape and a method for effectively manufacturing the element.

Such an object is achieved by a slide fastener element, which is a basic configuration of a metallic slide fastener element of the invention obtained by punching out a flat type wire rod, in which at least a cut surface of a side face region comprising right and left side faces of a coupling head and an outside peripheral side faces of right and left leg portions has, from a plan viewpoint, a shear surface of 80% or more and a fracture surface of less than 20%. Such a metallic element is manufactured securely and effectively according to a method for manufacturing the slide fastener element in which a metallic flat type wire rod is disposed on a die and the flat type wire rod is punched out with a punch, this method being characterized in that a mouth on a punch side of the die or a peripheral edge of the die is chamfered at a radius of 0.01 to 1.0 mm and a clearance T between the die and the punch is 0 to 30 μm.

An average surface roughness Ra of the shear surface on the cut surface of an element material just after punching out is preferred to be 1.0 a or less and an average surface roughness Ra of the shear surface is preferred to be 0.5 a or less. Further, it is preferable that the cut surface on at least an inner side of the leg portions of the slide fastener element has a shear surface of less than 80% while the remainder is a fracture surface. More preferably, the cut surface on the inner side of the leg portions is constituted of a shear surface of less than 50%.

According to the above-described manufacturing method, it is more preferable that the clearance (T) between the die and punch is 0.1 to 10 μm and the clearance (T) between the die and the punch and a thickness (t) of the flat type wire rod are preferred to satisfy the following equation (I):

$$0<T/t\leqq 0.001 \quad \text{(I)}$$

According to the individual element of the present invention, because its cut surface by punching is constituted of the shear surface of 80% or more, the outer peripheral face to be exposed outside of the coupling head and the right and left leg portions, when the element is implanted in a fastener tape, is provided with intensified smoothness, so that a demand for a slide fastener applied to particularly a high quality product is satisfied. To realize this smoothness, it is preferable to adopt the above-described manufacturing method of the present invention, and further, if the clearance T between the die and the punch is set to 0.1 to 10 μm, 90% or more of the cut surface can be constituted of the shear surface.

When a cut surface of metal is observed, the shear surface and fracture surface generally coexist on the cut surface. As for the shear surface and the fracture surface, if light is projected to a cut surface at a predetermined incident angle and a relating situation is observed from a position deviated from its just opposite position, the shear surface turns to dark black because the projected light is reflected regularly and conversely, the fracture surface seems to be white because the projected light is reflected irregularly. According to the present invention, the cut surface is so constructed that when the cut surface of the element obtained by punching out the flat type wire rod is observed, the area of a region occupied by the dark black is 80% or more with respect to a region occupied by the white. When 80% or more of the cut surface is constituted of the shear surface, the smoothness of the surface is high so that a high quality element uniformly finished at a high precision and having excellent in its appearance is produced. If the ratio is 90% or more, the fracture surface almost diminishes, so that it is excellent in terms of appearance design and can be applied as a more valuable product for a high quality brand product. To increase the ratio of the shear surface area to the cut surface, the method for manufacturing a slide fastener element of the present invention is capable of manufacturing the elements securely and effectively.

Meanwhile, in an element material obtained by punching out the flat type wire rod, burr is generated on a ridge line portion formed by cutting of the material if any particular process is not performed, and therefore, the material needs to pass through a special process such as barrel polishing or chemical polishing so as to obtain a final product. At this time, the shear surface produced at the time of punching out is flawed finely by rubbing due to grinding stone powder and then, the ratio of occupation by the shear surface area decreases as compared with the punching time. Nevertheless, in order to obtain the above-described element having the shear surface of 80% or more, the average surface roughness Ra of the shear surface in the cut surface needs to be 1.0 a or less. If it is intended to obtain an element having the shear surface area of 90% or more, the average surface roughness Ra needs to be 0.5 a or less.

On the other hand, at least the cut surface on the inner side of the leg portions of the aforementioned element is a portion to be attached to the fastener tape such that the fastener tape is nipped, and after this element is attached to the fastener tape, this portion is not exposed outside. Therefore, the area which the shear surface occupies at this portion is not so important and conversely, if the area which the fracture surface occupies is increased, the degree of fitting to the fastener tape is intensified, so that the fixing strength is increased. Thus, the area which the shear surface occupies in the cut surface on the inner side of the leg portions is set to less than 80% while the area which the fracture surface occupies is set to 20% or more. In order to intensify the fixing strength further, it is preferable to set the ratio of the fracture surface area to 50% or more.

To obtain such a cut surface, the clearance T between the die and the punch is set in a range of 0 to 30 μm and the mouth on the punch side of the die or the peripheral edge of the die is provided with a roundness of radius R. By setting this R to 0.01 to 1.0 mm, generation of crevice in the flat type wire rod is prevented and a slide fastener element in which the ratio of the shear surface with respect to the fracture surface is 80% or more is obtained.

Further, if the clearance T between the die and the punch and the thickness t of the flat type wire rod are made to satisfy the above-described equation (I), the ratio of the shear surface can be increased.

DESCRIPTION OF THE PREFERRED EMBODIMENTS

Figure 1:
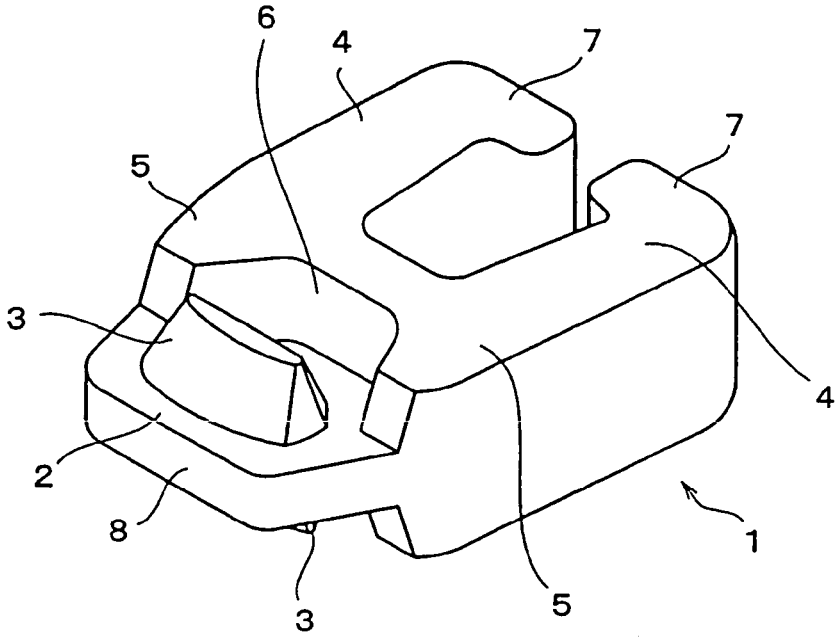
FIG. 1 is an outline view showing an example of a metallic slide fastener element of the invention.

Hereinafter, preferred embodiments of a metallic slide fastener element called individual element of the invention and a method for manufacturing the same will be described with reference to the accompanying drawings. An element 1 of the invention has been described in the patent document 3 and has the above-described shape and structure as shown in FIG. 1. Although the element 1 having the same shape and structure as the patent document 3 has been mentioned here, naturally, it is possible to adopt the shape and structure of the element described in each of the patent documents 1 and 2 and the other shape and structure.

Figure 13:
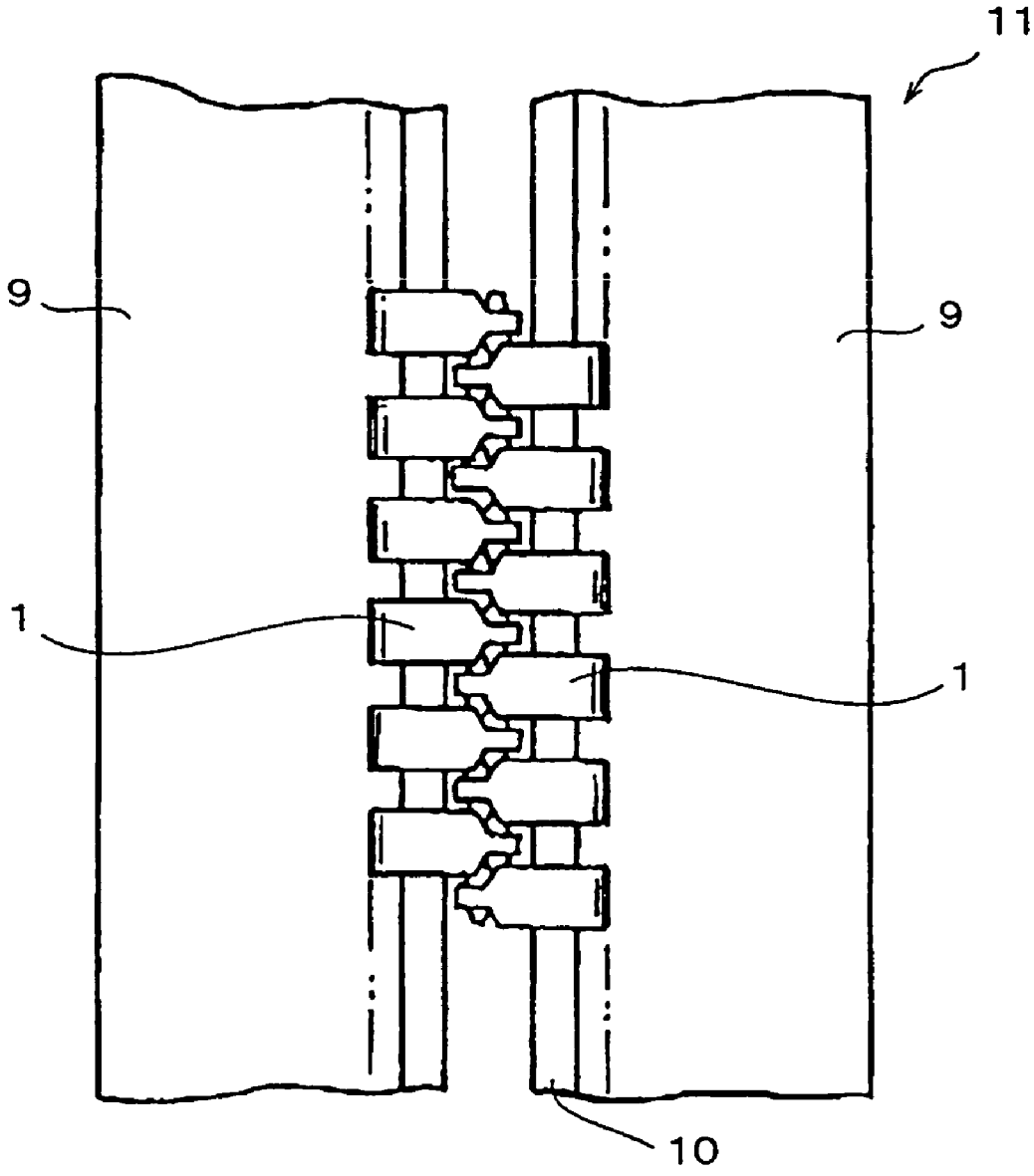
FIG. 13 is a partial plan view of a fastener chain on which the elements shown in FIG. 1 are mounted.

The metallic element 1 of this embodiment has projecting portions 3, which are engagement portions, in central portions of front and rear faces of a thin flat plate portion 8 of a coupling head 2 in which a trapezoidal shape and a rectangular shape are combined. As for a shape of each projecting portion 3, as shown in FIG. 1, this projecting portion provides a substantially pyramidal volume, which is longer in a width direction of the element 1 and in which the sectional area of a rectangular section in plan view decreases successively in a direction of leaving the thin flat plate portion 8. Further, a substantially U-shaped projecting edge portion 5 is provided on a side of right and left leg portions 4 of the thin flat plate portion 8 as if the projecting edge portion surrounds the projecting portion 3 with a predetermined gap with the same thickness as the leg portions 4. A substantially U-shaped fitting concave portion 6, to which a part of the projecting portion 3 of a mating element 1 is fitted when a fastener chain 10 shown in FIG. 13 is in engagement, is formed between the projecting portion 3 and the projecting edge portion 5. The pair of leg portions 4 are extended from an end face of the projecting edge portions 5 such that they are branched to right and left sides on the same plane. The thickness of each of the right and left leg portions 4 and the projecting edge portion 5 in the vertical direction is substantially three times the thin flat plate portion 8. Further, a pair of right and left nipping portions 7 are provided at ends of the right and left leg portions 4 such that they extend so as to approach each other.

Figure 2:
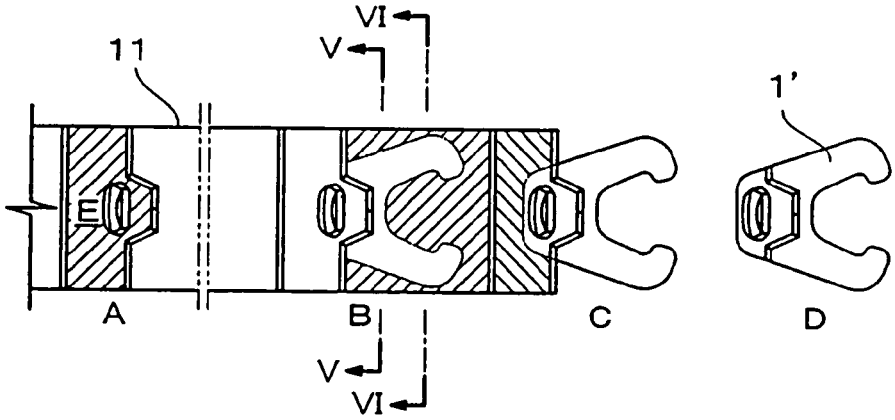
FIG. 2 is an explanatory view of a process for expressing steps of manufacturing the element successively in a same drawing.

A punched product (element material 1') of the element 1 having such a shape and structure is produced successively and continuously from a flat type wire rod 11 shown in FIG. 2 through plural press processes. The flat type wire rod 11 is carried intermittently from the left side to the right side in the same figure while stopped each time when pressing is carried out. The thickness of this flat type wire rod 11 is equal to the thickness of each of the right and left leg portions 4 and the projecting edge portion 5. In a first press process (A), a hatched portion of the flat type wire rod 11 is pressed by a molding die (not shown) from above and below, and as shown in (A) of the same figure, a coupling head area E is formed in the flat type wire rod 11. The projecting portion 3, and the thin flat plate portion 8 and the fitting concave portion 6 are simultaneously formed in this coupling head area E by pressing.

In a second press process shown in (B) of FIG. 2, the hatched portion is punched out by a die and a punch having the shape indicated with a phantom line with the coupling head area E, the substantially U-shaped projecting edge portions 5 and the right and left leg portions 4 left do as to provide a shape of a third step (C) shown in FIG. 2. Next, a remaining portion of the vertex of the coupling head 2 is punched out with the die and punch indicated by a phantom line in (C) of FIG. 2 and consequently, an element material 1' having a desired shape shown in (D) of FIG. 2 is produced. Such a manufacturing process is not particular to the invention but a process executed in the past.

Figure 3:
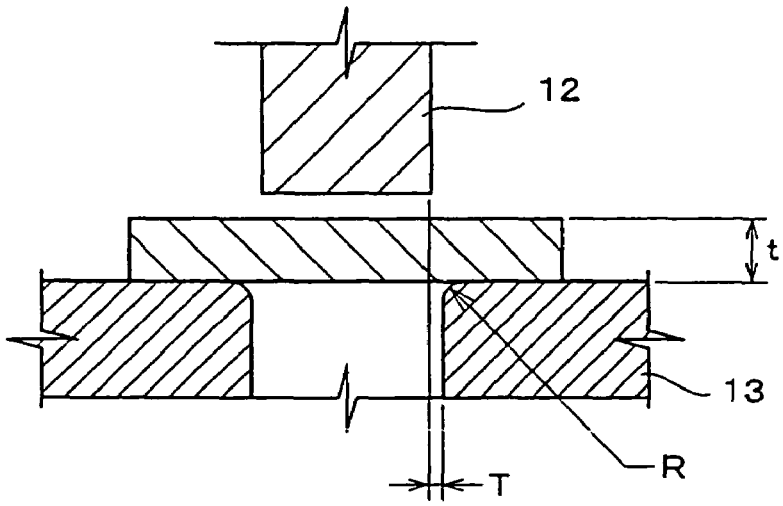
FIG. 3 is a longitudinal sectional view schematically showing a punch and a die applied to a manufacturing method of the invention.

The characteristic portion of the manufacturing method according to the invention is shown schematically in FIG. 3. As shown in FIG. 3, the dimension of a clearance T formed between the punch 12 and the die 13 is an important point for execution of the invention. In addition, forming roundness on a ridge line portion of a mouth (shoulder) of the die, that is, chamfering, is also an important point. According to this embodiment, the value of the aforementioned T is 0 to 30 μm, preferably in a range of 0.1 to 10 μm. If the value T is 0 μm, naturally, catching is generated between the punch and the die, hampering a smooth pressing. If it is 30 μm or more, a fracture surface increases in a punched face (cut surface), so that the ratio occupied by the shear surface, which is an initial object of the invention, drops largely below 80%. The appropriate value is in a range of 0.1 to 10 μm. Further, if the mouth (shoulder) of the die is chamfered, the radius R of the roundness is set to 0.01 to 1.0 mm. If this radius R is 0.01 mm or less, the fracture surface originating from crevice increases in the cut surface of a pressed product. If the radius R is 1.0 mm or more, the cutting itself is not carried out smoothly, so that not only the fracture surface increases but also a cut end is often curved or inclined.

As described previously, for this type of element 1, the element material 1' obtained by the press work undergoes a finishing process by barrel polishing or chemical polishing. Due to this polishing process, the roughness of a cut surface of the element material 1' tends to become rough. For the reason, in order to make the shear surface, which forms the characteristic portion of the invention, of the finished element 1 80% or more, it is necessary to form a shear surface wider than that value at the stage of the element material 1'. The factor affecting the shear surface at this time is the surface roughness Ra in the cut surface of the element material 1'. According to this embodiment, the average surface roughness Ra is set to 1.0 a or less and preferably, it is set to 0.5 a or less. Such a value can make the ratio, in which the shear surface occupies the cut surface in the element 1 after following polishing processing, is carried out to be 80%, preferably 90%.

Figure 4:
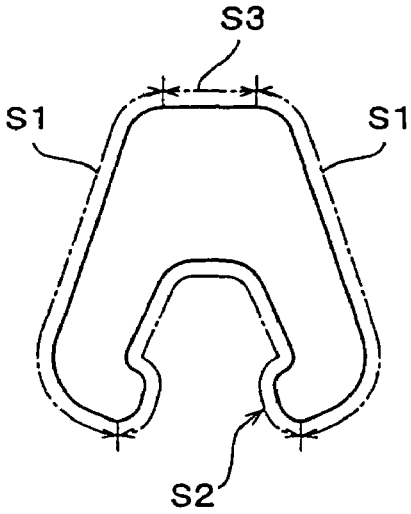
FIG. 4 is a plan view schematically showing a peripheral cut region of the element.

According to this embodiment, as regards all cut surfaces of the element material 1', the ratio of the shear surface with respect to the fracture surface is not set 80% or more. FIG. 4 indicates a boundary between a region S1 having the shear surface of 80% or more in the element 1 and a region S2 satisfying the shear surface of 80% or less. A region indicated with a symbol S3 in FIG. 4 indicates a portion which is not exposed outside when elements are engaged and which is hidden between the engaged elements, and it is preferable that the shear surface of the region S3 is set to 80% or more following the region S1 if possible. That is, in the element 1 shown in FIG. 4, right and left side faces of the coupling head 2 and an outside peripheral side faces of the right and left leg portions 4 are the region S1 while an inner peripheral side faces of the right and left leg portions 4 are S2. The remaining vertex of the coupling head 2 is the region S3.

Figure 5:
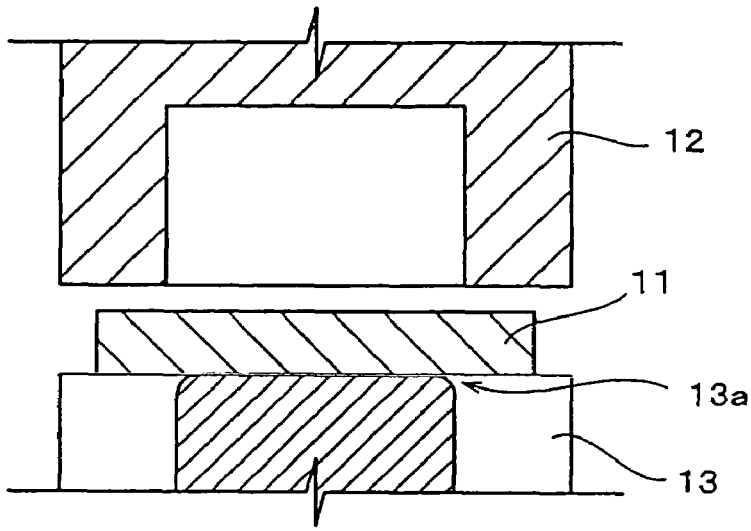
FIG. 5 is a sectional view schematically showing the punch and the die when cutting out an element taken along the line V-V in FIG. 2.
Figure 6:
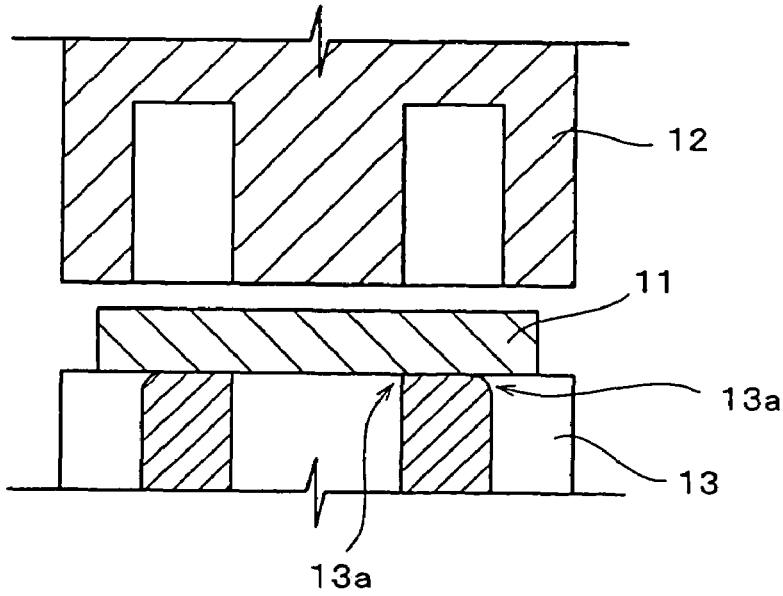
FIG. 6 is a sectional view schematically showing the punch and the die when cutting out an element taken along the line VI-VI in FIG. 2.

To form the outside peripheral side face region S1 and the coupling head vertex face S3, as shown in FIG. 5, the clearance T having the above-described predetermined dimension is formed between the punch 12 and the die 13, which constitutes the characteristic portion of the invention, and the ridge line portion of the mouth (shoulder) of the die 13 is chamfered at a radius R which is defined by the aforementioned predetermined value. As a result, the ratio of the shear surface can be 80% or more in the cut surfaces in the regions S1 and S3. As for the inner peripheral side face region S2 of the right and left leg portions 4, as shown in FIG. 6, the dimension of the clearance T formed between the punch 12 and the die 13 is set to the same as or a higher dimension than the conventional dimension over the aforementioned dimension specified according to the invention, and the mouth (shoulder) 13*a* of the die 13 is not chamfered. Alternately, if the aforementioned dimension specified by the invention is exceeded by the dimension of the clearance T, the ratio of the shear surface decreases extremely, so that the ratio of the fracture surface exceeds 50%.

In addition, if in the inner peripheral side face region S2 of the right and left leg portions 4, the dimension of the clearance T defined between the punch 12 and the die 13 is set to the aforementioned dimension specified by the invention and the mouth (shoulder) 13*a* of the die 13 is not chamfered, the ratio of the shear surface increases but it is difficult for it to exceed 80%. From this fact, it is understood that for manufacturing of the element 1 of the invention, the clearance T which satisfies the aforementioned value in the invention and chamfering at the radius R are indispensable. By forming the region S2 having a number of fractures faces in the inner peripheral faces of the right and left leg portions 4, biting into the aforementioned side edge of the fastener tape 9 including a core thread portion 10 increases, so that a strong mounting is enabled.

Further, according to a preferred embodiment, the clearance T (μm) between the punch 12 and the die 13 and the thickness t (mm) of the flat type wire rod need to satisfy the following equation (I).

$$0<T/t\leqq 0.001 \quad (1)$$

If the clearance T and the thickness t of the flat type wire rod satisfy the equation (I), the ratio of the shear surface increases.

Next, specific examples of the present invention will be described by comparing with a conventional example.

EXAMPLES

The clearance T between the punch 12 and the die 13 shown schematically by FIGS. 5 and 6 is set to 5 μm (Example 1), 20 μm (Example 2) and 0 μm (Comparative example). In addition, the shoulder of the die 13 for cutting the outside peripheral side face region S1 and the coupling head vertex face region S3 in Examples 1 and 2 is chamfered at the radius R of 0.15 mm, and the shoulder of the die 13 for forming the outside peripheral side face region S1, which is an outside cut surface of the right and left leg portions 4, is chamfered at the radius R of 0.15 mm also like the outside peripheral side face region S1 and the coupling head vertex face region S3, as shown in FIG. 6. On the other hand, the shoulder of the die 13 for forming the inner peripheral side face region S2, which is an inside cut surface of the right and left leg portions 4, is not chamfered. Further, in the comparative example, the shoulder of the die 13 is not chamfered. As the flat type wire rod 11 which is a raw material of the element 1, aluminum alloy of 0.9 to 1.5 mm in thickness was used depending on the size of the element 1 for both Examples 1 and 2 and Comparative example.

FIGS. 7 to 12 show an appearance condition of the shear surface and fracture surface of the right side face and left side face in each element 1 having an intermediate size according to Examples 1 and 2 and Comparative example. These figures are views of photographs of each element 1 taken with light projected obliquely downward to the element 1 from above. Its hatched area indicates a shear surface region C1 and in the photograph, this area is expressed in dark black. On the other hand, a non-hatched area indicates a fracture surface region C2 and in the photograph, this area is expressed in white. An evaluation on each element described below is taken upon an element which is obtained by applying barrel polishing on the element material 1' punched out with the punch 12.

Figure 7:
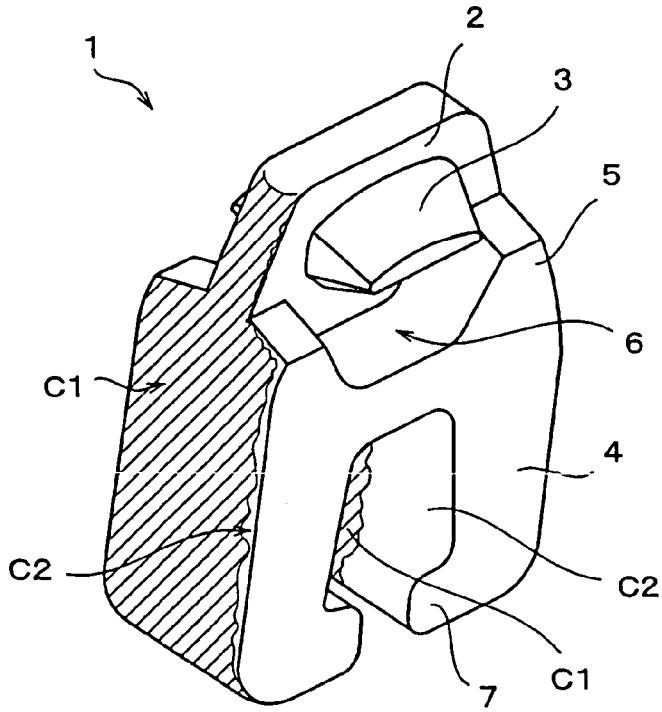
FIG. 7 is a perspective view of an element according to a first embodiment of the invention as seen from a left side.
Figure 8:
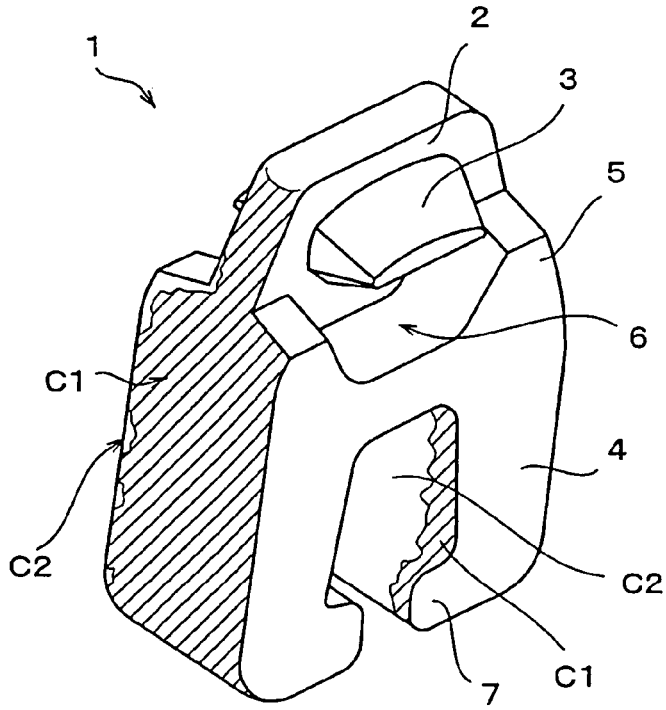
FIG. 8 is a perspective view of the element according to the first embodiment as seen from a right side.
Figure 9:
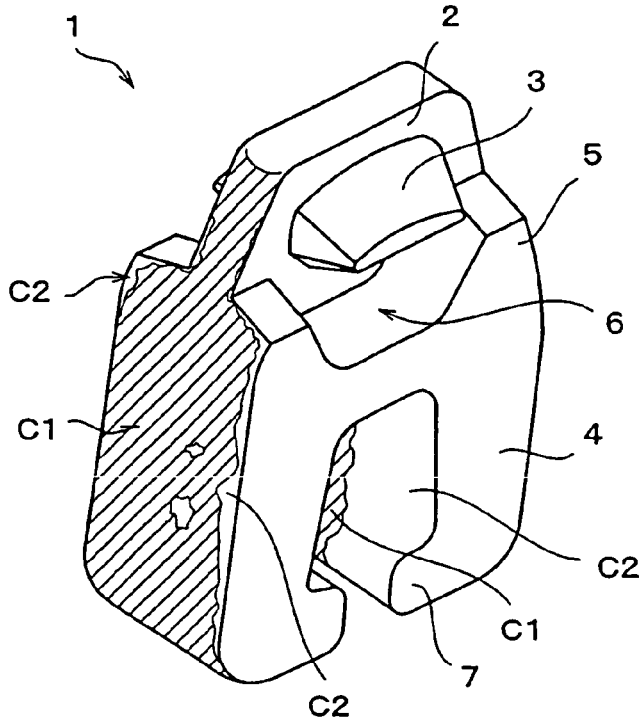
FIG. 9 is a perspective view of an element according to a second embodiment of the invention as seen from a left side.
Figure 10:
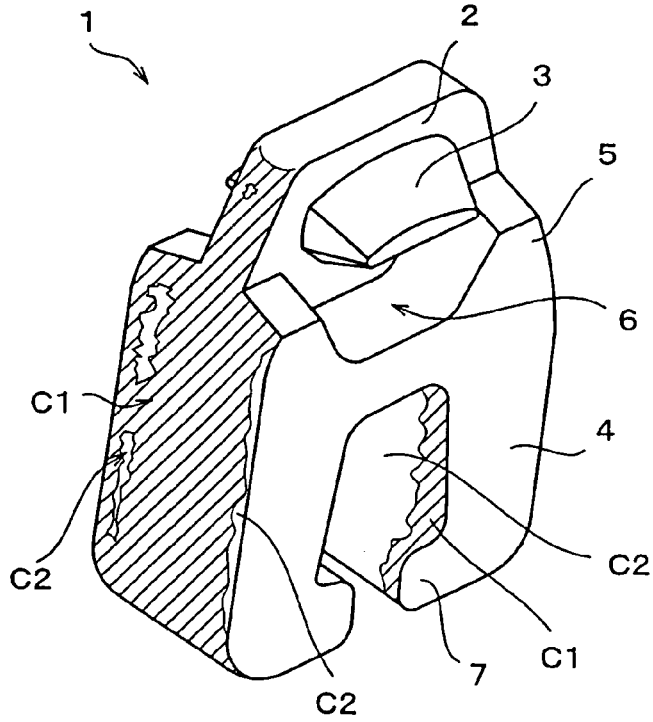
FIG. 10 is a perspective view of the element according to the second embodiment as seen from a right side.

According to FIG. 7, which is a perspective view taken from the left side, as for the element 1 of Example 1, the shear surface region C1 on the outside peripheral side face of the element 1 is 98% or more, and most part is the shear surface. According to FIG. 8, which is a perspective view taken from the right side, the shear surface region C1 on the outside peripheral side face occupies 95% or more. As for the element of Example 2, according to FIG. 9, which is a perspective view taken from the left side, the shear surface region C1 on the outside peripheral side face of the element 1 occupies 85% or more, and according to FIG. 10, which is a perspective view taken from the right side, the shear surface region C1 on the outside peripheral side face occupies near 90%.

Figure 11:
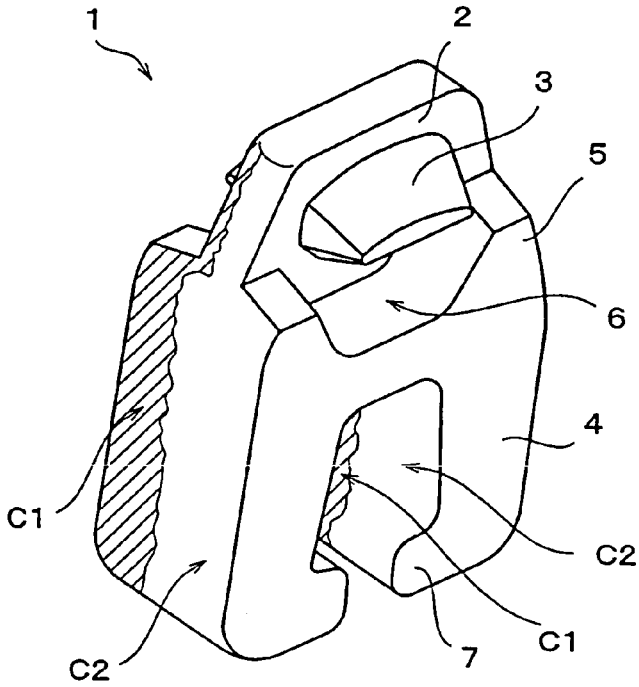
FIG. 11 PRIOR ART
FIG. 11 is a perspective view of a conventional element according to a comparative example as seen from a left side.
Figure 12:
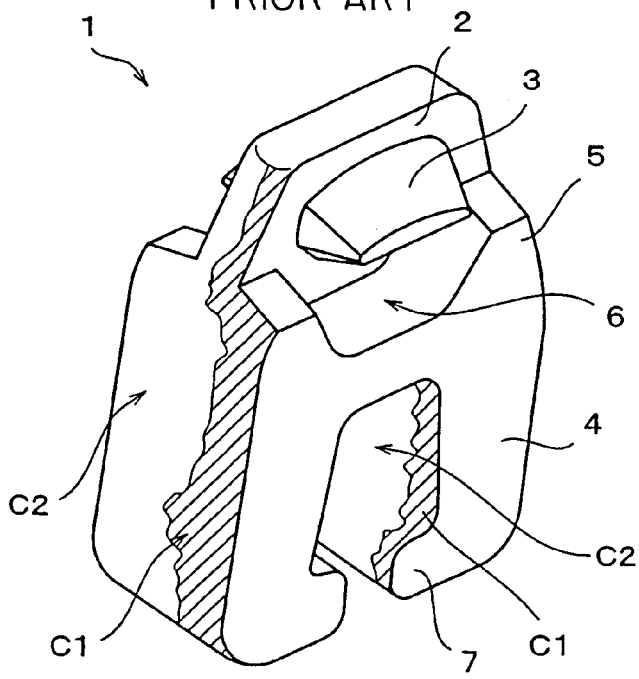
FIG. 12 PRIOR ART
FIG. 12 is a perspective view of the conventional element as seen form a right.

On the other hand, in case of the element 1 according to Comparative example, as shown in FIG. 11, which is a perspective view taken from the left side, the shear surface region C1 on the outside peripheral side face of the element 1 is far below 50%, and also as shown in FIG. 12, which is a perspective view taken from the right side, the shear surface region C1 on the outside peripheral side face is 50% or less. As regards the inner peripheral side face of each of the right and left leg portions 4 of the element 1, few shear surface exists in any case of Examples 1 and 2 and Comparative example, and the fracture surface occupies 80% or more.

As understood from above description, according to the metallic slide fastener element 1 of the invention obtained by punching out the flat type wire rod, the surface of an exposed portion outside when it is installed on the fastener tape 9 is constituted of the shear surface of 80% or more, as compared with the metallic element manufactured in the conventional method. Accordingly, its appearance is finished very beautiful and if the inner peripheral side face of each of the right and left leg portions 4 is constituted of the fracture surface of 50% or more, the installation strength when it is installed on the fastener tape 9, particularly its laterally pulling strength is intensified. Thus, the slide fastener on which the same elements 1 are mounted is preferably attached to a high quality product such as a high quality brand product.

What is claimed is:

1. A slide fastener element manufactured by punching out a metallic flat type wire rod with a press and comprising a coupling head and right and left leg portions extending separately as two branches from the coupling head, wherein at least a cut surface of a side face region comprising right and left side faces of the coupling head and an outside peripheral right side face of the right leg portion and an outside peripheral left side face of the left leg portion has a shear surface of 80% or more and a fracture surface of less than 20%, and at least a cut surface of an inside of the right and left leg portions has a shear surface of less than 50% while the remainder is a fracture surface.

2. The slide fastener element according to claim 1, wherein an average surface roughness of the shear surface on a cut surface of an element material, which is immediately after punched out, is 1.0 μm or less.

3. The slide fastener element according to claim 2, wherein the average surface roughness of the shear surface on the cut surface is 0.5 μm or less.

* * * * *